US009347139B2

(12) United States Patent
Holtermann et al.

(10) Patent No.: US 9,347,139 B2
(45) Date of Patent: May 24, 2016

(54) METHODS OF REMOVING A PROTECTIVE LAYER

(71) Applicant: Chevron Phillips Chemical Company LP, The Woodlands, TX (US)

(72) Inventors: Dennis L. Holtermann, Conroe, TX (US); Tin-Tack Peter Cheung, Kingwood, TX (US); Christopher D. Blessing, Jubail Industrial (SA); Lawrence E. Huff, Kingwood, TX (US); Joseph Bergmeister, III, Kingwood, TX (US); Robert L. Hise, Humble, TX (US); Geoffrey E. Scanlon, Humble, TX (US); David W. Dockter, Kingwood, TX (US)

(73) Assignee: Chevron Phillips Chemical Company LP, The Woodlands, TX (US)

( * ) Notice: Subject to any disclaimer, the term of this patent is extended or adjusted under 35 U.S.C. 154(b) by 0 days.

(21) Appl. No.: 13/955,511

(22) Filed: Jul. 31, 2013

(65) Prior Publication Data

US 2014/0007903 A1 Jan. 9, 2014

Related U.S. Application Data

(63) Continuation of application No. 13/180,163, filed on Jul. 11, 2011, now Pat. No. 8,535,448.

(51) Int. Cl.

| | |
|---|---|
| ***C23G 5/024*** | (2006.01) |
| ***C23G 1/02*** | (2006.01) |
| ***C23F 1/12*** | (2006.01) |
| ***C23F 1/44*** | (2006.01) |
| ***C10G 35/06*** | (2006.01) |
| ***C10G 35/09*** | (2006.01) |

(52) U.S. Cl.

CPC ..... *C23G 5/024* (2013.01); *C10G 35/065* (2013.01); *C10G 35/09* (2013.01); *C23F 1/12* (2013.01); *C23F 1/44* (2013.01); *C23G 1/02* (2013.01)

(58) Field of Classification Search

None

See application file for complete search history.

(56) References Cited

U.S. PATENT DOCUMENTS 4,498,932 A 2/1985 Kruka
4,578,100 A * 3/1986 Breininger ..... C03C 17/22 134/28

(Continued)

FOREIGN PATENT DOCUMENTS

WO 2013009495 A1 1/2013

OTHER PUBLICATIONS

Foreign communication from a related counterpart application—International Search Report and Written Opinion, PCT/US2012/044863, Oct. 25, 2012, 10 pages.

(Continued)

*Primary Examiner* — Nicole Blan

(74) *Attorney, Agent, or Firm* — Conley Rose, P.C.; Rodney B. Carroll; Monte R. Rhodes

(57) ABSTRACT

A method of removing a metal protective layer from a surface of a reactor component comprising treating the metal protective layer with one or more chemical removal agents to remove at least a portion of the metal protective layer from the reactor component. A method of removing a metal protective layer from a surface of a reactor component comprising treating the metal protective layer to remove the metal protective layer from the reactor component, and determining a thickness of the reactor component following treatment.

18 Claims, 1 Drawing Sheet

(56) References Cited

U.S. PATENT DOCUMENTS

| | | | | |
|---|---|---|---|---|
| 5,071,486 | A * | 12/1991 | Chasteen | 134/2 |
| 5,405,525 | A | 4/1995 | Heyse et al. | |
| 5,406,014 | A | 4/1995 | Heyse et al. | |
| 5,413,700 | A | 5/1995 | Heyse et al. | |
| 5,593,571 | A | 1/1997 | Heyse et al. | |
| 5,674,376 | A | 10/1997 | Heyse et al. | |
| 5,676,821 | A | 10/1997 | Heyse et al. | |
| 5,685,041 | A | 11/1997 | Sivacoe | |
| 5,795,402 | A | 8/1998 | Hargett, Sr. et al. | |
| 5,807,842 | A | 9/1998 | Buscemi et al. | |
| 5,849,969 | A | 12/1998 | Heyse et al. | |
| 5,903,945 | A * | 5/1999 | Lundie | 15/104.061 |
| 6,019,000 | A * | 2/2000 | Stanke et al. | 73/622 |
| 6,413,436 | B1 * | 7/2002 | Aegerter et al. | 216/13 |
| 6,419,986 | B1 | 7/2002 | Holtermann et al. | |
| 6,527,869 | B1 | 3/2003 | Bourg | |
| 6,548,030 | B2 | 4/2003 | Heyse et al. | |
| 6,551,660 | B2 * | 4/2003 | Holtermann et al. | 427/250 |
| 6,878,041 | B2 * | 4/2005 | Esser et al. | 451/39 |
| 6,902,628 | B2 | 6/2005 | Wang et al. | |
| 7,087,651 | B2 | 8/2006 | Lee-Tuffnell et al. | |
| 7,509,962 | B2 | 3/2009 | O'Meara et al. | |
| 8,026,542 | B2 | 9/2011 | Mcdaniel et al. | |
| 8,119,203 | B2 | 2/2012 | Hise et al. | |
| 8,535,448 | B2 | 9/2013 | Holtermann et al. | |
| 2003/0132416 | A1 * | 7/2003 | Boguslavsky et al. | 252/2 |
| 2004/0099285 | A1 * | 5/2004 | Wang et al. | 134/8 |
| 2005/0054737 | A1 * | 3/2005 | Lee-Tuffnell et al. | 518/703 |
| 2006/0275551 | A1 * | 12/2006 | Hise et al. | 427/383.1 |
| 2006/0289918 | A1 * | 12/2006 | McDaniel et al. | 257/296 |
| 2007/0296967 | A1 * | 12/2007 | Gupta et al. | 356/318 |
| 2008/0314408 | A1 | 12/2008 | Jeong et al. | |
| 2011/0092741 | A1 * | 4/2011 | Fazio | C07C 209/16 564/480 |

OTHER PUBLICATIONS

Davis, J. R., "Metals Handbook," Desk Edition, 2nd Edition, 1998, 1 page, ASM International.

Tailoka, F., et al., "Removal of tin from tin coated steel by chlorination in air," XP-002685127, Ironmaking and Steelmaking, 2003, pp. 385-390, vol. 30, No. 5, IoM Communications Ltd.

Foreign communication from a related counterpart application—International Preliminary Report on Patentability, PCT/US2012/044863, Jan. 14, 2014, 7 pages.

* cited by examiner

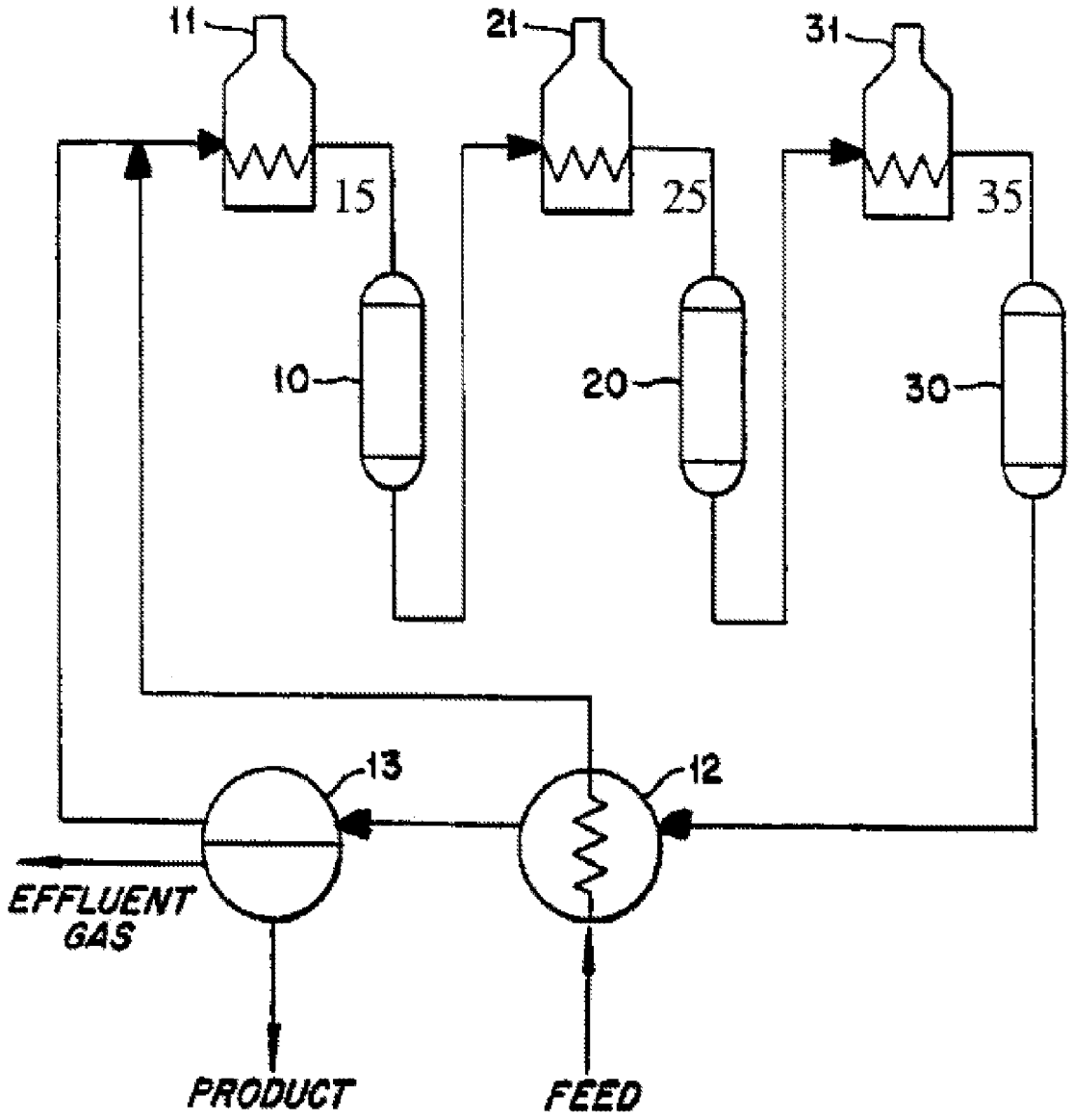
11
21
31
15
25
35
10
20
30
13
12
EFFLUENT GAS
PRODUCT
FEED

METHODS OF REMOVING A PROTECTIVE LAYER

CROSS-REFERENCE TO RELATED APPLICATIONS

This application is a continuation of U.S. application Ser. No. 13/180,163 filed Jul, 11, 2011 and published as U.S. 2013/0014780A1, now U.S. Pat. No. 8,535,448, and entitled "Methods of Removing a Protective Layer , " which is incorporated herein by reference in its entirety, for all purposes.

FIELD

This disclosure relates generally to methods of removing a metal protective layer from a reactor component. More specifically, this disclosure relates to methods for removing a metal protective layer from one or more components of a hydrocarbon conversion system.

BACKGROUND

The hydrocarbons processed in reactor systems often have adverse secondary effects on the reactor metallurgy. Chemical attack on a metal substrate of the various components of reactor systems, such as furnace tubes, reactor vessels, or internal reactor structures may result in the degradative processes of carburization, metal dusting, halide stress corrosion cracking, and/or coking.

"Carburization" refers to the injection of carbon into the substrate of the various components of a reactor system. This carbon can then reside in the substrate at the grain boundaries. Carburization of the substrate can result in embrittlement, metal dusting, or a loss of the component's mechanical properties. "Metal dusting" results in a release of metal particulates from the surface of the substrate. "Coking" refers to a plurality of processes involving the decomposition of hydrocarbons to essentially elemental carbon. Halide stress corrosion cracking can occur when austenitic stainless steel contacts aqueous halide and represents a unique type of corrosion in which cracks propagate through the alloy. All of these degradative processes alone or in combination can result in considerable financial losses in terms of both productivity and equipment.

In the petrochemical industry, the hydrocarbons and impurities contained therein processed by hydrocarbon conversion systems can attack metal substrates associated with a hydrocarbon conversion system and the various internal reactor structures contained therein. "Hydrocarbon conversion systems" include isomerization systems, catalytic reforming systems, catalytic cracking systems, thermal cracking systems, and alkylation systems, among others.

"Catalytic reforming systems" refer to systems for the treatment of a hydrocarbon feed to provide an aromatics enriched product (i.e., a product whose aromatics content is greater than in the feed). Typically, one or more components of the hydrocarbon feed undergo one or more reforming reactions to produce aromatics. During catalytic reforming a hydrocarbon/hydrogen feed gas mixture is passed over a precious metal containing catalyst at elevated temperatures. Nonlimiting examples of catalysts useful for reforming include platinum and optionally rhenium or iridium on an alumina support, platinum on type X and Y zeolites, provided the reactants and products are sufficiently small to flow through the pores of the zeolites, platinum on cation exchanged type L zeolites and bimetallic catalysts. The bimetallic catalyst compositions employed in reforming operations include those comprising platinum, palladium or rhodium in combination with one or more metal promoters or metallic activating elements which form active catalyst complexes with a halogen promoter.

At elevated temperatures, the hydrocarbons and chemical reagents can react with the substrate of the reactor system components to form coke. In time, the coke can eventually break free from the substrate causing damage to downstream equipment and restricting flow at downstream screens, catalyst beds, treater beds, and exchangers. When the catalytic coke erupts from the surface of the substrate, then breaks free, a minute-sized piece of metal may be removed from the substrate to form a pit. Eventually, the pits will grow and erode the substrate of the hydrocarbon conversion system and internal reactor structures contained therein until repair or replacement is required.

Traditionally, the hydrocarbon feeds processed in catalytic reforming reactor systems contain small amounts of sulfur, which is an inhibitor of degradative processes, such as carburization, coking, and metal dusting. However, zeolitic reforming catalysts developed for use in catalytic reforming processes are susceptible to deactivation by sulfur. Thus, systems employing these catalysts must operate in a low-sulfur environment that offers less protection for the substrate metallurgy and increases the rate of degradative processes such as those discussed previously.

An alternative method for inhibiting degradation in a hydrocarbon conversion system, such as in a catalytic reforming reactor system, involves formation of a protective layer on the substrate surface with a protective material that is resistant to the degradative processes described above and chemical reagents. These protective materials form a layer termed a "metal protective layer" (MPL). Various metal protective layers and methods of applying the same are disclosed in U.S. Pat. Nos. 6,548,030, 5,406,014, 5,674,376, 5,676,821, 6,419,986, 6,551,660, 5,413,700, 5,593,571, 5,807,842, 5,849,969, and U.S. Patent Application Publication No. 2006/0275551A1, each of which is incorporated by reference herein in its entirety.

An MPL may be formed by applying a layer of a material containing at least one metal on a surface of the substrate to form an applied metal layer (AML). The AML may be thermally and/or chemically processed at elevated temperatures ("Cured") as needed to form the MPL. The uniformity and thickness of the MPL, in addition to the composition of the MPL are important factors in its ability to inhibit reactor system degradation. While the MPL may provide protection of a substrate they may eventually require replacement or removal. For example, a partially degraded MPL may be removed before applying a new or different MPL or a reactor system may be converted to a new catalyst and new process conditions that could require removal of an existing MPL that may be incompatible with the new process conditions. The reactor system may have to be shutdown for some time period depending on the amount and nature of the MPL to be removed. Thus, it would be desirable to develop a methodology for efficiently removing a metal protective layer from a reactor surface.

SUMMARY

Disclosed herein is a method of removing a metal protective layer from a surface of a reactor component comprising treating the metal protective layer with one or more chemical removal agents to remove at least a portion of the metal protective layer from the reactor component.

Also disclosed herein is a method of removing a metal protective layer from a surface of a reactor component comprising treating the metal protective layer to remove the metal protective layer from the reactor component, and determining a thickness of the reactor component following treatment.

BRIEF DESCRIPTION OF THE DRAWINGS

For a more complete understanding of the present disclosure and the advantages thereof, reference is now made to the following brief description, taken in connection with the accompanying drawing and detailed description, wherein like reference numerals represent like parts.

FIG. 1 is a prior art schematic of a catalytic reforming reactor system.

The foregoing has outlined rather broadly the features and technical advantages of the present invention in order that the detailed description of the disclosure that follows may be better understood. Additional features and advantages that form the subject of the claims of this disclosure will be described hereinafter. It should be appreciated by those skilled in the art that the conception and the specific embodiments disclosed could be readily utilized as a basis for modifying or designing other structures for carrying out the same purposes of the present invention. It should also be realized by those skilled in the art that such equivalent constructions do not depart from the spirit and scope of this disclosure as set forth in the appended claims.

DETAILED DESCRIPTION

Disclosed herein are methodologies for the removal of a metal protective layer (MPL) from a substrate such as the surface of a reactor or reactor component. In an embodiment, a method for the removal of an MPL from a reactor surface comprises chemical removal of the MPL, mechanical removal of the MPL, or combinations thereof. Chemical and mechanical methods of treating a reactor surface to remove an MPL as will be described in more detail herein may result in removal of greater than about 50 wt. %, greater than about 75 wt. %, greater than about 85 wt. %, or about 100 wt. % of an MPL. Herein, the weight percentage of the MPL removed is based on the total weight of the MPL. The methodologies disclosed herein may be applied to remove an MPL of the type described herein from an entire reactor system including reactors, individual internal reactor structures, furnaces, or from any other reactor surface having an MPL. Examples of reactor surfaces having an MPL are disclosed later herein. The methodologies described herein for the removal of an MPL from a reactor surface may be utilized as described or modified to fit the needs of the user.

The MPL may comprise one or more protective materials capable of rendering a reactor surface resistant to degradative processes such as halide stress corrosion cracking, coking, carburization, and/or metal dusting. In an embodiment, the MPL is formed from an applied metal layer (AML). As used herein, AML generally refers to the characteristics of the layer containing the protective material prior to and/or after application thereof to a reactor surface, but prior to subsequent processing or chemical conversion, such as via reduction, curing, etc. As used herein, MPL generally refers to the characteristics of the protective material after such post-application processing or chemical conversion. In other words, AML generally refers to a precursor layer containing the protective material whereas MPL generally refers to a final protective material.

In an embodiment, there is formed a protective layer comprising the protective material anchored, adhered, or otherwise bonded to the reactor surface. In an embodiment, the protective material may be a material capable of rendering a reactor surface resistant to degradative processes such as halide stress corrosion cracking, coking, carburization, and/or metal dusting. In another embodiment, the protective material is a metal or combination of metals. In an embodiment, a suitable metal may be any metal or metal-containing compounds resistant to forming carbides or coke under conditions of hydrocarbon conversion such as catalytic reforming. Examples of suitable metals or metal-containing compounds include without limitation compounds of tin such as stannides; antimony such as antimonides; bismuth such as bismuthides; silicon; lead; mercury; arsenic; germanium; indium; tellurium; selenium; thallium; copper; chromium; brass; intermetallic alloys; or combinations thereof. While not wishing to be bound by theory, it is believed that the suitability of various metal compounds in the AML/MPL may be selected and classified according to their resistance to carburization, halide stress corrosion cracking, metal dusting, coking, and/or other degradation mechanisms.

The AML may be formulated to allow the protective materials to be deposited, plated, cladded, coated, painted, or otherwise applied onto the reactor surface. In an embodiment, the AML comprises a coating, which further comprises a metal or combination of metals suspended or dissolved in a suitable solvent. A solvent as defined herein is a substance, usually but not limited to a liquid, capable of dissolving or suspending another substance. The solvent may comprise a liquid or solid that may be chemically compatible with the other components of the AML. An effective amount of solvent may be added to the solid components to render the viscosity such that the AML is sprayable and/or spreadable. Suitable solvents include without limitation alcohols, alkanes, ketones, esters, dibasic esters, or combinations thereof. The solvent may be methanol, ethanol, 1-propanol, 1-butanol, 1-pentanol, 2-methyl-1-propanol, neopentyl alcohol, isopropyl alcohol, propanol, 2-butanol, butanediols, pentane, hexane, cyclohexane, heptane, methylethyl ketone, any combination thereof, or any other solvent described herein.

The AML may further comprise an effective amount of additives for improving or changing the properties thereof, including without limitation thickening, binding, or dispersing agents. In an embodiment, the thickening, binding, or dispersing agents may be a single compound. Without wishing to be limited by theory, thickening, binding, or dispersing agents may modify the rheological properties of the AML such that the components thereof are dispersed in the solvent and maintain a stable viscosity by resisting separation of the solvent from the protective materials (i.e. sedimentation). Addition of a thickening, binding, or dispersing agent may also allow the AML to become dry to the touch when applied on a reactor surface and resist running or pooling. Suitable thickening, binding, or dispersing agents are known to one of ordinary skill in the art with the benefits of this disclosure. In an embodiment, the thickening, binding, or dispersing agent is a metal oxide.

In an embodiment, the AML may be a metal coating comprising an effective amount of a protective material in the form of a hydrogen decomposable metal compound, a finely divided metal, and a solvent. The hydrogen decomposable metal compound may be any organometallic compound that decomposes to a smooth metallic layer in the presence of hydrogen. In some embodiments, the hydrogen decomposable metal compound comprises organotin compounds, organoantimony compounds, organobismuth compounds, organosilicon compounds, organolead compounds, organoarsenic compounds, organogermanium compounds, organoindium compounds, organtellurium compounds, organoselenium compounds, organocopper compounds, organochromium compounds, or combinations thereof. In an alternative embodiment, the hydrogen decomposable metal compound comprises at least one organometallic compound such as $MR^1R^2R^3R^4$, where M is tin, antimony, bismuth, silicon, lead, arsenic, germanium, indium, tellurium, selenium, copper, or chromium and where each $R^{1-4}$ is a methyl, ethyl, propyl, butyl, pentyl, hexyl, halides, or mixtures thereof. In a further embodiment, the hydrogen decomposable metal compound comprises a metal salt of an organic acid anion containing from 1 to 15 carbon atoms, wherein the metal may be tin, antimony, bismuth, silicon, lead, arsenic, germanium, indium, tellurium, selenium, copper, chromium or mixtures thereof. The organic acid anion may be linear or branched compounds of acetate, propionate, isopropionate, butyrate, isobutyrates, pentanoate, isopentanoate, hexanoate, heptanoate, octanoate, nonanoate, decanoate oxyolate, neodecanoate, undecanoate, dodecanoate, tredecanoate, tetradecanoate, dodecanoate, 2-ethylhexanoic acid, or combinations thereof.

The finely divided metal may be added to the AML to ensure the presence of reduced metal capable of reacting with the substrate even under conditions where the formation of reduced metal is disfavored such as low temperatures or a non-reducing atmosphere. In an embodiment, the finely divided metal may have a particle size of from about 1 μm to about 20 μm. Without wishing to be limited by theory, metal of this particle size may facilitate uniform coverage of the substrate by the AML.

In an embodiment, the aforementioned AML may be a tin-containing coating comprising at least four ingredients (or their functional equivalents): (i) a hydrogen decomposable tin compound, (ii) a solvent system (as described previously), (iii) a finely divided tin metal, and (iv) tin oxide as a reducible thickening, binding, or dispersing agent. The coating may comprise finely divided solids to minimize settling.

Ingredient (i), the hydrogen decomposable tin compound, may be an organotin compound. The hydrogen decomposable tin compound may comprise tin octanoate or neodecanoate. These compounds will partially dry to a gummy consistency on the reactor surface that is resistant to cracking and/or splitting, which is useful when a coated reactor surface is handled or stored prior to curing. Tin octanoate or neodecanoate will decompose smoothly to a tin layer which forms iron stannide in hydrogen at temperatures from as low as about 600° F. (316° C.). In an embodiment, the tin octanoate or neodecanoate may further comprise less than or equal to about 5 wt %, alternatively less than or equal to about 15 wt %, alternatively less than or equal to about 25 wt %, of the respective octanoic acid or neodecanoic acid. Tin octanoate has been given Registry Number 4288-15-7 by Chemical Abstracts Service. Tin neodecanoate has been given Registry Number 49556-16-3 by Chemical Abstracts Service.

Finely divided tin metal, ingredient (iii), may be added to ensure that reduced tin is available to react with the reactor surface even under conditions where the formation of reduced metal may be disfavored such as at low temperatures or under non-reducing conditions. The particle size of the finely divided tin metal may be from about 1 μm to about 20 μm which allows excellent coverage of the reactor surface to be coated with tin metal. Non-reducing conditions may be conditions with low amounts of reducing agent or low temperatures. The presence of reduced tin ensures that even when part of the coating cannot be completely reduced, tin metal will be present to react and form the desired MPL layer. Without wishing to be limited by theory, metal of this particle size may facilitate uniform coverage of the reactor surface by the AML.

Ingredient (iv), the tin oxide thickening, binding, or dispersing agent, may be a porous tin-containing compound which can absorb an organometallic tin compound, yet still be reduced to active tin in a reducing atmosphere. The particle size of the tin oxide may be adjusted by any means known to one of ordinary skill in the art. For example, the tin oxide may be processed through a colloid mill to produce very fine particles that resist rapid settling. Addition of tin oxide may provide an AML that becomes dry to the touch, and resists running. In an embodiment, ingredient (iv) is selected such that it becomes an integral part of the MPL when reduced.

In one embodiment, an AML may be a coating comprising less than or equal to about 65 wt %, alternatively less than or equal to about 50 wt %, alternatively from about 1 wt % to about 45 wt % hydrogen decomposable metal compound; metal oxide; metal powder; and solvent (e.g., isopropyl alcohol). The weight percent of the components of the AML is based on the total weight of the AML including the solvent. In a further embodiment, an AML may be a tin coating comprising up to about 65 wt %, alternatively up to about 50 wt %, alternatively from about 1 wt % to about 45 wt % hydrogen decomposable tin compound; tin oxide; tin powder; and solvent (e.g., isopropyl alcohol).

An AML applied to a substrate as a wet coating may be further processed in addition to, in lieu of, or in conjunction with drying to provide an MPL that is resistant to the degradative processes described previously. Examples of further processing of the AML to form the MPL include but are not limited to curing and/or reducing. In an embodiment, the AML may be applied to a reactor surface as a material that dries to form a coating, which may be further cured and/or reduced to form the MPL.

The following is a description of the various reactor surfaces to which an MPL may be applied with the understanding that the presently disclosed methods of removing an MPL include removal from such reactor surfaces. The AML/MPL described previously herein may be used on any reactor surface to which it adheres, clings, or binds, and provides protection from degradative processes. In an embodiment, any system comprised of a coking-sensitive, carburization-sensitive, halide stress-corrosion cracking sensitive, and/or metal-dusting sensitive material may serve as a reactor surface for the AML/MPL. In a further embodiment, the reactor surface may comprise carbon steel, mild steel, alloy steel, stainless steel, austenitic stainless steel, or combinations thereof. Examples of systems that may contain reactor surfaces for the AML/MPL include without limitation systems such as hydrocarbon conversion systems, refining systems such as hydrocarbon refining systems, hydrocarbon reforming systems, hydrocarbon conversion systems, hydrocarbon reactor systems, or combinations thereof. The term "reactor system" or "reactor system component" as used herein includes one or more reactors containing at least one catalyst and its corresponding furnace, heat exchangers, connecting piping, recycle systems, etc. Examples of internal reactor structures that may serve as reactor surfaces include heat exchangers; furnace internals such as interior walls, furnace tubes, furnace liners, etc.; and reactor internals such as interior reactor walls, flow distributors, risers, scallops, center pipes, or other structures normally associated with a radial flow catalytic reactor. In an embodiment, the reactor surface may be an internal reactor structure of a hydrocarbon conversion reactor system.

In an alternative embodiment, the reactor surface may be an internal reactor structure of a catalytic reformer reactor system.

In an embodiment, the reactor surface may be a reactor system component or an internal reactor structure within a catalytic reforming reactor system such as that shown in FIG. 1. The reforming reactor system may include a plurality of catalytic reforming reactors (10), (20) and (30). Each reactor contains a catalyst bed. The system also includes a plurality of furnaces (11), (21) and (31); heat exchanger (12); separator (13); a plurality of pipes (15), (25), and (35) connecting the furnaces to the reactors; and additional piping connecting the remainder of the components as shown in FIG. 1. It will be appreciated that this disclosure is useful in continuous catalytic reformers utilizing moving beds, as well as fixed bed systems. Catalytic reforming systems are described in more detail herein and in the various patents incorporated by reference herein.

In an embodiment, the reactor surface may a reactor system component of a hydrocarbon conversion system or an internal reactor structure thereof. The hydrocarbon conversion system may function to oxidatively convert hydrocarbons to olefins and dienes. Alternatively, the hydrocarbon conversion system may function to non-oxidatively convert hydrocarbons to olefins and dienes. Alternatively, the hydrocarbon conversion system may function to carry out any number of hydrocarbon conversion system reactions. In various embodiments, hydrocarbon conversion system reactions comprise without limitation, the dehydrogenation of ethylbenzene to styrene, the production of ethylbenzene from benzene and ethylene, the transalkylation of toluene to benzene and xylenes, the dealkylation of alkylaromatics to less substituted alkylaromatics, the production of fuels and chemicals from hydrogen and carbon monoxide, the production of hydrogen and carbon monoxide from hydrocarbons, the production of xylenes by the alkylation of toluene with methanol, the conversion of light hydrocarbons to aromatics, or removal of sulfur from motor gasoline products.

In another embodiment, the reactor surface may be a part of a refining system or a component thereof. As used herein refining systems includes processes for the enrichment of a particular constituent of a mixture through any known methodology. One such methodology may comprise catalytic conversion of at least a portion of a reactant to the desired product. An alternative methodology may involve the separation of a mixture into one or more constituents. The extent of separation may be dependent on the design of the refining system, the compounds to be separated and the separation conditions. Such refining systems and enrichment conditions are known to one skilled in the art with the aid and benefits of the present disclosure.

The reactor surface may have a metallurgy comprising halide stress corrosion cracking-sensitive, carburization-sensitive, coking-sensitive, and/or metal-dusting sensitive compounds such as nickel, iron, or chromium. In an embodiment, the substrate metallurgy may be any metallurgy containing a sufficient quantity of iron, nickel, chromium, or any other suitably reactive metal to react with the metal in the AML and form a uniform protective layer. In an embodiment, the reactor surface metallurgy may be any metallurgy containing a sufficient quantity of iron, nickel, or chromium to react with tin and form a stannide layer. In an embodiment, the reactor surface metallurgies comprise 300 and 400 series stainless steel.

The metallurgical terms used herein are to be given their common metallurgical meanings as set forth in THE METALS HANDBOOK of the American Society of Metals, incorporated herein by reference. As used herein, "carbon steels" are those steels having no specified minimum quantity for any alloying element (other than the commonly accepted amounts of manganese, silicon and copper) and containing only an incidental amount of any element other than carbon, silicon, manganese, copper, sulfur, and phosphorus. As used herein, "mild steels" are those carbon steels with a maximum of about 0.25 wt % carbon. As used herein, "alloy steels" are those steels containing specified quantities of alloying elements (other than carbon and the commonly accepted amounts of manganese, copper, silicon, sulfur, and phosphorus) within the limits recognized for constructional alloy steels, added to effect changes in mechanical or physical properties. Alloy steels will contain less than about 10 wt % chromium. As used herein, "stainless steels" are any of several steels containing at least about 10 wt %, alternatively about 12 wt % to about 30 wt % chromium as the principal alloying element. As used herein, "austenitic stainless steels" are those having an austenitic microstructure. These steels are known in the art with the benefits of this disclosure. Examples include 300 series stainless steels such as 304 and 310, 316, 321, 347. Austenitic stainless steels typically contain between about 16 wt % and about 20 wt % chromium and between about 8 wt % and about 15 wt % nickel. Steels with less than about 5 wt % nickel are less susceptible to halide stress corrosion cracking. Suitable reactor surfaces may comprise one or more of the foregoing metallurgies.

In an embodiment, an MPL may be removed from a reactor surface by treating the metal protective layer with a chemical agent for removal (CAR), a mechanical agent and/or technique for removal (MAR), or combinations thereof. Hereafter the CAR and MAR may be collectively referred to as removal agents (RAs). In an embodiment, the reactor surface may be simultaneously or sequentially treated with an RA to remove the MPL, and such treatments may be alternated or repeated as needed. For example, an MPL may be treated with a CAR and then a MAR or vice versa to effect removal of the MPL.

Treatment of reactor surfaces with an RA as described herein may result in the formation of movable compounds such as reactive metal species that require sequestration to prevent them from negatively impacting downstream reactor components and/or processes. Various sequestration techniques such as those described herein may be used to immobilize and/or remove moveable compounds formed by treatment of an MPL with an RA.

In an embodiment, an MPL as described previously may be removed chemically from a reactor surface such as those described herein. As will be understood by one of ordinary skill in the art with the benefits of this disclosure, methods and conditions for chemically removing an MPL will vary depending on the nature (i.e., composition, thickness) of the MPL to be removed. For example, CARs for the removal the MPL may comprise halogen-containing compounds, sulfur-containing compounds, oxygen-containing compounds, or combinations thereof.

In an embodiment, the CAR comprises a halogen-containing compound. As used herein, the term "halogen-containing compound" includes, but is not limited to, elemental halogen, acid halides, alkyl halides, aromatic halides, and other organic halides including those containing oxygen and nitrogen, inorganic halide salts and halocarbons, or combinations thereof. For example and without limitation, a CAR suitable for the removal of an MPL comprises chlorine gas, fluorine gas, iodine, bromine, hydrochloric acid, hydrobromic acid, hydrofluoric acid, hydroiodic acid, and combinations thereof. Water may optionally be present. In an embodiment, a gas comprising HCl may be used as the CAR. The halogen-containing compounds may be present in an amount of from about 0.1 ppm to about 50,000 ppm, alternatively of from about 1 ppm to about 5000 ppm, alternatively of from about 10 ppm to about 1000 ppm alternatively of from about 50 ppm to about 500 ppm.

In an embodiment, the MPL is exposed to a CAR at a temperature of from about 200° F. (93° C.) to about 1,600° F. (871° C.), alternatively of from about 250° F. (121° C.) to about 950° F. (510° C.), alternatively of from about 300° F. (149° C.) to about 900° F. (482° C.), alternatively of from about 500° F. (260° C.) to about 700° F. (371° C.) for a period of from about 1 hours to about 500 hours.

In an embodiment, the MPL comprises tin stannide and the CAR comprises chlorine gas. Without wishing to be limited by theory, the CAR may react with tin to form a chlorinated tin compound such as for example $SnCl_2$ (equation 1) which may then be removed from the reactor surface using any suitable methodology. For example, the chlorinated tin compound may be removed by washing with a solvent or in the case of volatile compounds flushed out with a gas.

$$Sn+Cl_2 \rightarrow SnCl_2 \quad (1)$$

In such embodiments, the MPL may be contacted with $Cl_2$ gas present in an amount of from about 1 ppm to about 50,000 ppm, alternatively from about 10 ppm to about 20,000 ppm, alternatively from about 20 ppm to about 10,000 ppm in a temperature range of from about 200° F. (93° C.) to about 1600° F. (871° C.), alternatively from about 250° F. (121° C.) to about 950° F. (510° C.), alternatively from about 300° F. (149° C.) to about 900° F. (482° C.), alternatively of from about 500° F. (260° C.) to about 700° F. (371° C.), for greater than about 1 hour; alternatively for from about 1 hour to about 500 hours.

In an embodiment, the MPL comprises tin stannide and the CAR comprises fluorine gas. In an alternative embodiment, the MPL comprises tin stannide and the CAR comprises hydrofluoric acid. Without wishing to be limited by theory, the CAR (i.e., fluorine or hydrofluoric acid) may react with the tin to form a fluorinated tin compound such as for example $SnF_2$ (equation 2) which may then be removed from the reactor surface using any suitable methodology. For example, the fluorinated tin compound may be removed by washing with a solvent or in the case of volatile compounds flushed out with a gas.

$$Sn+F_2 \rightarrow SnF_2 \quad (2)$$

In such embodiments, the MPL may be contacted with $F_2$ gas present in an amount of from about 1 ppm to about 50,000 ppm, alternatively from about 10 ppm to about 20,000 ppm, alternatively from about 20 ppm to about 10,000 ppm in a temperature range of from about 200° F. (93° C.) to about 1600° F. (871° C.), alternatively from about 250° F. (121° C.) to about 950° F. (510° C.), alternatively from about 300° F. (149° C.) to about 900° F. (482° C.), alternatively of from about 500° F. (260° C.) to about 700° F. (371° C.), for from about 1 hour to about 500 hours.

The CAR may comprise a sulfur-containing compound, an oxygen-containing compound, or combinations thereof. In an embodiment, the MPL comprises tin stannide and the CAR comprises sulfonyl chloride ($SO_2Cl$). In such embodiments, the MPL may be contacted with $SO_2Cl$ present in an amount of from about 0.1 ppm to about 50,000 ppm, alternatively from about 1 ppm to about 20,000 ppm, alternatively from about 2 ppm to about 10,000 ppm in a temperature range of from about 200° F. (93° C.) to about 1600° F. (871° C.), alternatively from about 250° F. (121° C.) to about 950° F. (510° C.), alternatively from about 300° F. (149° C.) to about 900° F. (482° C.), alternatively of from about 500° F. (260° C.) to about 700° F. (371° C.), for from about 1 hour to about 500 hours. Without wishing to be limited by theory, the CAR may react with the tin to form a chlorinated tin compound such as for example $SnCl_2$ (equation 3) which may then be removed from the reactor surface using any suitable methodology. For example, the chlorinated tin compound may be removed by washing with a solvent or in the case of volatile compounds flushed out of the system with a gas.

$$Sn+2SO_2Cl \rightarrow SnCl_2+2SO2 \quad (3)$$

In an embodiment, the MPL comprises tin stannide and the CAR comprises hydrochloric acid (HCl). In such embodiments, the MPL may be contacted with hydrochloric acid present in an amount of from about 1 ppm to about 50,000 ppm HCl, alternatively from about 10 ppm to about 20,000 ppm HCl, alternatively from about 20 ppm to about 10,000 ppm HCl in a temperature range of from about 200° F. (93° C.) to about 1600° F. (871° C.), alternatively from about 250° F. (121° C.) to about 950° F. (510° C.), alternatively from about 300° F. (149° C.) to about 900° F. (482° C.), alternatively of from about 500° F. (260° C.) to about 700° F. (371° C.), for from about 1 hour to about 500 hours. Without wishing to be limited by theory, the reaction of hydrochloric acid and oxygen with tin may lead to the oxychlorination of tin as shown in equation 4.

$$2Sn+4HCl \rightarrow 2SnCl_2+2H_2 \quad (4)$$

In an embodiment, the MPL comprises tin stannide and the CAR comprises sulfuric acid ($H_2SO_4$). In such embodiments, the MPL may be contacted with $H_2SO_4$ present in an amount of from about 1 ppm to about 50,000 ppm, alternatively from about 10 ppm to about 20,000 ppm, alternatively from about 20 ppm to about 10,000 ppm in a temperature range of from about 200° F. (93° C.) to about 1600° F. (871° C.), alternatively from about 250° F. (121° C.) to about 950° F. (510° C.), alternatively from about 300° F. (149° C.) to about 900° F. (482° C.), alternatively of from about 500° F. (260° C.) to about 700° F. (371° C.), for from about 1 hour to about 500 hours. Without wishing to be limited by theory, the CAR may react with the tin to produce tin sulfate as shown in equation 5:

$$2Sn+H_2SO_4 \rightarrow SnSO_4+H_2 \quad (5)$$

In an embodiment, the MPL comprises tin stannide and the CAR comprises oxygen ($O_2$). In such embodiments, the MPL may be reacted in an atmosphere containing oxygen gas at a pressure of from about 0.1 ppm to about 50,000 ppm, alternatively from about 2 ppm to about 30,000 ppm, alternatively from about 3 ppm to about 20,000 ppm in a temperature range of from about 200° F. (93° C.) to about 1600° F. (871° C.), alternatively from about 250° F. (121° C.) to about 1500° F. (816° C.), alternatively from about 300° F. (149° C.) to about 1400° F. (760° C.), alternatively of from about 500° F. (260° C.) to about 1100° F. (593° C.) for from about 1 hour to about 500 hours. In such embodiments, the oxygen concentration in the atmosphere may range from about 0.5 mol % to about 20 mol %, alternatively from about 1 mol % to about 10 mol %, alternatively from about 3 mol % to about 7 mol %. Without wishing to be limited by theory, the CAR may react with the tin to produce tin oxide as shown in equation 6:

$$Sn+O_2 \rightarrow SnO_2 \quad (6)$$

In an embodiment, a method for the removal of a MPL from a reactor surface comprises chemical treatment of the reactor surface with a CAR as disclosed herein. The use of a CAR may result in greater than about 20% of the MPL being removed, alternatively greater than about 30%, alternatively greater than about 50%, alternatively greater than about 75%, alternatively greater than about 85%, alternatively greater than about 95%. Following treatment with a CAR, any remaining MPL may be subjected to a MAR as described herein.

In an embodiment, an MPL as described previously may be removed mechanically from the reactor surface using a mechanical agent and/or technique for removal (MAR) alone or in combination with a CAR as described above. MARs for the removal of an MPL may include without limitation, abrasive blasting, hydroblasting, an abrasive material, or combinations thereof.

In an embodiment, a MAR comprises abrasive blasting. Herein, abrasive blasting refers to the application of a jet of solid particles to the surface of a substrate which are accelerated by means of a conveying medium such as air. In an embodiment, the MPL may be removed from a reactor surface by abrasive blasting with an abrasive material such as for example and without limitation sand, aluminum oxide, silicon carbide, sodium bicarbonate, plastic pellets, walnut hulls, and the like. Abrasive blasting may be carried out using techniques and devices as known to one of ordinary skill in the art with the benefits of this disclosure. Devices that may be used in abrasive blasting are described in more detail later herein.

In an alternative embodiment, a MAR comprises an abrasive material. In such embodiments, the abrasive material may be applied in the presence of or in the absence of a conveying medium. Application of the abrasive material to the reactor surface coated with an MPL may be carried out manually, may be automated, or both. For example, the reactor and/or reactor component may be scrubbed with a wire brush, abrasive material, or abrasive polymer such as a polymeric scour pad. Non-limiting examples of polymeric scour pads include Scotch-Brite® Pads commercially available from 3M. In an embodiment, the reactor surface may be simultaneously or sequentially treated with an abrasive material and a CAR to remove the MPL, and such treatments may be alternated or repeated as needed.

In an embodiment, a MAR comprises hydroblasting. Herein, hydroblasting refers to the application of water under high pressure or ultra high pressure to a surface of the substrate. Herein, "high pressure" is a pressure greater than about 70 bar (1,000 psi) while ultra high pressure is a pressure greater than about 210 bar (3,000 psi). In an embodiment, the MAR comprises hydroblasting at a pressure of from about 3000 psi to about 5000 psi. In some embodiments, the water may also contain an abrasive material such as those described previously and the MAR would then comprise both hydroblasting and abrasive blasting.

In an embodiment, the MAR may be carried out using any device or apparatus as known to one of ordinary skill in the art with the benefits of this disclosure. In cases where the MPL is on the interior of a reactor component, for example the interior of a furnace tube the MPL may be removed using an abrasive blast or hydroblast pig. Herein, a pig is a device designed to travel within the interior of a component such as a pipe or tube and emit a material under pressure. A pig may comprise a body having an outer circumference closely matching the inner circumference of the component to be treated with the MAR. Alternatively, a pig may comprise legs that adjust to match the inner circumference of the component and a body having an outer circumference much smaller than the inner circumference of the component to be treated with the MAR. For example, a pig can be shaped like a football with brushes poking out or raised "scrapers." The pig may be inserted into the reactor component and moved through the component by any means known to one of ordinary skill in the art with the benefits of this disclosure. For example, the pig may be moved through the reactor component by the application of air pressure to the outer body of the pig. The pig may also be moved through the reactor component by the use of cables to pull or rods to push the pig. Such pigs may further comprise a nozzle or a plurality of nozzles for the emission of pressurized material (e.g., abrasive material, water). Pigs may alternatively comprise a rotating device which propels material (e.g., abrasive material, water), pressurized or non-pressurized, toward the substrate. In an embodiment, the pig may also comprise a device designed to contact the reactor surface following the application of the abrasive material or water and transport the deposits with the pig through the reactor component. Furthermore, the pig may comprise a mechanism by which the device is able to overcome restrictions or obstructions in the reactor component. For example, the outer body of the pig may be compressible allowing for the device to distort or alter its shape to facilitate passage through narrow areas of the reactor component. Pigs for use in cleaning a pipeline and related devices are described in U.S. Pat. Nos. 6,527,869, 5,795,402, and 4,498,932, each of which is incorporated by reference herein in its entirety.

In some embodiments, prior to use of an MAR, the reactor surface may be heated. The reactor surface may be pretreated by heating at temperatures equal of from about 100° F. (38° C.) to about 2000° F. (1093° C.), alternatively equal to or greater than about 120° F. (49° C.), alternatively equal to or greater than about 150° F. (66° C.) for from about 1 hour to about 500 hours. The heating of the reactor surface to the disclosed temperatures may reduce the adherence of the MPL to the reactor surface allowing for the MPL to be more easily removed using a MAR. In other embodiments, the reactor surface may be heated following treatment with a mechanical agent for removal. In this embodiment, the reactor surface may be heated to temperatures of from about 100° F. (38° C.) to about 2000° F. (1093° C.), alternatively equal to or greater than about 120° F. (49° C.), alternatively equal to or greater than about 150° F. (66° C.) for from about 1 hour to about 500 hours. In yet other embodiments, the reactor surface may be heated prior to treatment with a mechanical agent for removal and following treatment with a mechanical agent for removal.

In an alternative embodiment, a method for the removal of an MPL from a reactor surface comprises chemically treating the reactor surface with a CAR followed by mechanical treatment with MARs. The chemically and mechanically treated reactor surface may then be subjected to temperatures of from about 100° F. (38° C.) to about 2000° F. (1093° C.), alternatively equal to or greater than about 120° F. (49° C.), alternatively equal to or greater than about 150° F. (66° C.) for from about 1 hour to about 500 hours. Without wishing to be limited by theory, the portion of the MPL remaining following treatment with the MARs may be alloyed with the reactor surface by subjecting the reactor surface to the temperature ranges disclosed.

As will be understood by one of ordinary skill in the art, an alternative to the removal of an MPL from a reactor that is to be operated under new reactor conditions detrimental to the MPL is to render the MPL inactive or inaccessible. For example, the MPL may be bound in place by heating the MPL to temperatures equal to or greater than about 1800° F. (982° C.), alternatively equal to or greater than about 1650° F. (899° C.), alternatively equal to or greater than about 1600° F. (871° C.) for from about 1 hour to about 2000 hours. Without wishing to be limited by theory, the MPL may be alloyed with the reactor surface by subjecting the reactor surface to the temperature ranges disclosed. Alternatively, a second coating that is compatible with the new reactor conditions may be applied to the reactor components such that the coating prevents exposure of the MPL to reactor conditions that may be detrimental to or incompatible with the MPL. Such coatings, their compositions and methods for their application are known to one of ordinary skill in the art with the benefits of this disclosure.

Following treatment of a reactor surface with an RA (e.g., a CAR and/or an MAR), the MPL may be converted from a material that substantially adheres to the reactor surface to a reactive and mobile material that may be easily removed. In an embodiment, following treatment with an RA, the reactive and mobile material generated is sequestered to prevent the material from progressing downstream where it may react to the detriment of other reactor components. The term "sequestration" as used herein means to purposely trap reactive and mobile compounds such as metals, metal compounds, or other reactants, and/or reaction products from the application of the RA to the MPL. Sequestration also refers to sorbing, reacting, or otherwise trapping the RA and/or making the RA inert to prevent any detrimental reaction with other reactor components and/or products of the reaction of the RA and MPL. The terms "movable metals" or "movable tin" as used herein refer to the reactive and mobile metal and tin compounds formed from the reaction with the RA. Generally, it is the movable metals and the remaining RA that are sequestered. The movable metals may include reactive metals such as reactive tin. As used herein, the term "reactive metals," such as "reactive tin," is intended to include elemental metals or metal compounds that are present in or on MPL layers which may be mobilized when chemically or mechanically treated. The term "reactive metals" as used herein comprises metal compounds that will migrate at temperatures from about 200° F. (93° C.) to about 1,400° F. (760° C.), which would thereby result in catalyst deactivation or equipment damage during operation of the new catalytic reactor system. The following discussion of sequestration will focus on movable metals, including reactive metals, with the understanding that any moveable compound used or formed from the application of the RA may also be sequestered in like fashion. Such movable metals may be formed, for example, via the reaction on an MPL with a CAR.

In an embodiment, the MPL comprises tin stannide that is reacted with a CAR to produce "reactive tin." When used in the context of reforming, the term "reactive tin" comprises any one of elemental tin, tin compounds, tin intermetallics, tin alloys, or combinations thereof that will migrate at temperatures from about 200° F. (93° C.) to about 1,400° F. (760° C.), which would thereby result in catalyst deactivation during reforming operations or during heating of the reformer furnace tubes. In other contexts, the presence of reactive metals will depend on the particular metals, the mobilization agent, as well as the reactor process and its operating conditions. Such reactive metals (e.g., reactive tin) may be sequestered as described herein.

Sequestration of the movable compounds, for example and without limitation movable metals and/or CAR, may be done using chemical or physical treating steps or processes. The sequestered compounds may be concentrated, recovered, or removed from the reactor system. In an embodiment, the movable metals may be sequestered by contact with an adsorbent, by reaction with a compound that will trap the movable metals, or by dissolution, such as by washing the reactor surface with a solvent and removing the dissolved movable metals.

The choice of sorbent depends on the particular form of the movable metals and its reactivity for the particular movable metals. In an embodiment, the sorbent may be a solid or liquid material (an adsorbent or an absorbent) which will trap the movable metals. Suitable liquid sorbents include water, liquid metals such as tin metal, caustic, and other high pH scrubbing solutions. Solid sorbents effectively trap the movable metals by adsorption or by reaction. Solid sorbents are generally easy to use and subsequently easy to remove from the system. A solid sorbent may have a high surface area (such as greater than about 3-5 $m^2/g$), have a high coefficient of adsorption with the movable metals and mobilization agent or react with the movable metals and mobilization agent to trap same. A solid sorbent retains its physical integrity during this process such that the sorbent maintains an acceptable crush strength, attrition resistance, etc. The sorbents can also include metal turnings, such as iron turnings that will react with movable tin chloride. In an embodiment, the sorbents may be aluminas, clays, silicas, silica aluminas, activated carbon, zeolites, or combinations thereof. In an alternative embodiment, the sorbent may be a basic alumina, such as potassium on alumina, or calcium on alumina.

In an embodiment, the sorbent may comprise a reactor catalyst. For example, a CAR may be applied to an MPL comprising tin stannide to form reactive tin such as $SnCl_2$. The reactive tin may be then contacted with a compound such as a reformer catalyst which will react with and effectively trap the $SnCl_2$. In such embodiments, the reformer catalyst used to trap the $SnCl_2$ is considered a "sacrificial catalyst" as it will be deactivated by contacting with the mobilized tin. In an embodiment, the sorbent may comprise silver such as for example silver nitrate. In such embodiments, the reactive tin (i.e., $SnCl_2$), may reduce the silver to silver metal and be trapped by the silver sorbent. In an embodiment, the sorbent may comprise copper. In such embodiments, the reactive tin may alloy with the copper to form bronze.

Sequestration and other processes for removal of reactive metals are disclosed in U.S. Pat. Nos. 6,551,660 and 6,419,986, each of which is incorporated by reference herein in its entirety.

As will be understood by one of ordinary skill in the art, the agents used for removal (i.e., RAs) of an MPL from the reactor surface may result in some degradation of the reactor surface. The degradation of the reactor surface may be evinced by a reduction in the thickness of the reactor surface. Methods for the determination of a reactor surface thickness are known to one of ordinary skill in the art with the benefits of this disclosure and include for example and without limitation thickness gauges. One type of reactor surface thickness gauging comprises mechanical gauging which encompasses a variety of nondestructive and destructive techniques such as for example and without limitation IR or nuclear gauges, eddy current, magnetic particle, laser, ultrasonic, coulometric, X-ray or, combinations thereof.

In an embodiment, a method for the removal of an MPL from a reactor surface further comprises determination of the thickness the reactor surface before and after removal of the MPL. In such embodiments, the thickness of the reactor surface may be determined using IR or nuclear gauges, eddy current, magnetic particle, laser, ultrasonic, coulometric, X-ray or, combinations thereof. Beta, IR or nuclear gauge testing involves the absorption of x-ray, infrared or Beta particle radiation to measure the thickness of a reactor surface or coating. On a coated reactor surface, the radiation or Geiger-Muller detector is located on the same side and backscattered radiation is measured. Coulometric gauge instruments use an electrochemical process to etch away a plated or metallic layer at a predetermined rate. The amount of time to remove the plated layer provides an indication of coating thickness. Eddy current thickness gauges use an electromagnet to induce an eddy current in a conductive substrate. The response of the reactor surface to the induced current is sensed. Laser thickness gauges include methods such as laser shearography, magneto-optical, holographic interferometry, or other optical techniques to measure thickness. Ultrasonic instruments use beams of high frequency acoustic energy that are introduced into the reactor surface and subsequently retrieved. Thickness or distance calculations are based on the speed of sound through the material being evaluated. Thickness gauges using penetrating X-rays or gamma rays capture images of the internal structure or a part or finished product. The density and composition of the internal features will alter the intensity or density of these features in the X-ray image. Densitometers are used to quantify the density variations in the X-ray image and thus determine the thickness. Instrumentation and conditions for use of these methods to determine thickness of the substrate before and after removal of the MPL are known to one of ordinary skill in the art with the benefits of this disclosure.

In an embodiment, an MPL may be removed as described herein from a reactor surface. Such reactor surfaces may have an MPL that is at least partially degraded. Following removal of the MPL the reactor surface may be recoated with a new MPL. Alternatively, an MPL may be removed from a reactor surface prior to the use of the reactor under conditions incompatible with or detrimental to the MPL.

In an embodiment, the reactor is a catalytic reformer employing a zeolitic reforming catalyst and the MPL is removed from the reactor surfaces that make up the reactor system during conversion of the reactor to a catalytic reformer employing a bimetallic reforming catalyst. The term catalytic reforming as used herein refers to conversion of hydrocarbons over a reforming catalyst in the absence of added water, (e.g., less than about 1,000 ppm of water). This process differs significantly from steam reforming which entails the addition of significant amounts of water as steam, and is most commonly used to generate synthesis gas from hydrocarbons such as methane.

Herein, catalytic reforming employing a bimetallic reforming catalyst refers to reactions carried out under conditions wherein sulfur may be included in the reactor in amounts effective to prevent the degradation of the reactor components by processes such as carburization and coking as previously described herein. Bimetallic reforming catalysts typically comprise a Group VIII metal (e.g., platinum) on an alumina support and may incorporate a second metal (e.g. rhenium or tin). In contrast, catalytic reformers employing a zeolitic reforming catalyst typically require low-sulfur conditions due to the sulfur-sensitivity of the catalyst. A zeolitic reforming catalyst may comprise a large-pore zeolite including an alkali or alkaline earth metal charged with one or more Group VIII metals. A zeolitic reforming catalyst may additionally comprise one or more halogens.

In an embodiment, hydrocarbons are converted by contacting the hydrocarbon with a zeolitic catalyst, wherein the hydrocarbon or reaction products from the converting contact the substrate having the MPL. In an embodiment, a hydrocarbon conversion system has austenitic stainless steel components that are subject to degradation by processes previously described herein. This hydrocarbon conversion system may further comprise a zeolitic reforming catalyst as has also been previously described herein. This hydrocarbon conversion system may have had some or all of the surfaces of the reactor system components protected with an MPL that then provided the reactor with improved resistance to degradative processes. For example, an AML may have been applied to the reactor surface of the hydrocarbon conversion system, as a wet coating that may dry by evaporation of the solvent or other carrier liquid to form a dry coating that may be suitable for handling. An AML applied as a wet coating may have been further processed in addition to, in lieu of, or in conjunction with drying to provide an MPL that is resistant to the degradative processes described previously. Examples of further processing of the AML to form the MPL include but are not limited to curing and/or reducing. In an embodiment, the AML may be applied as a coating that dries to form a dried coating, which may be further Cured and/or reduced to form the MPL.

In an embodiment, conversion of a hydrocarbon conversion system to a conventional catalytic reformer comprises removal of a MPL from the surface of the reactor or reactor components. The component may be for example a reactor wall, a furnace tube, a furnace liner, a reactor scallop, or combinations thereof. The removal may be effected using CARs, MARs, or combinations thereof as has been previously described herein. Once the MPL has been removed, the method may further comprise loading the reformer with a conventional sulfur-tolerant catalyst as known in the art with the benefits of this disclosure and has been previously described herein.

As will be understood by one of ordinary skill in the art with the aid of this disclosure, not all reactor components may require removal of the MPL for conversion of an unconventional catalytic reformer to a conventional catalytic reformer. In an embodiment, a method for the conversion of an unconventional catalytic reformer to a conventional catalytic reformer comprises replacing one or more reactor components comprising an MPL with similar or otherwise identical components lacking an MPL. For example, a method for the conversion of an unconventional catalytic reformer to a conventional catalytic reformer may comprise replacing reactor parts such as reactor scallops and removing the MPL from other reactor components such as the vessel walls. The MPL may be removed from an assembled or unassembled reactor component.

A reactor surface (e.g., reactor scallop, furnace tube) may have the MPL removed and optionally be processed as described in this disclosure at any convenient site. In an embodiment, the removal of the MPL may be carried out at the reactor operation site, distal to the reactor operation site, or proximal to the reactor operation site. In an embodiment, the reactor surface may have the MPL removed at a location other than the reactor operation site and/or ex situ the reactor system. In an embodiment, a reactor component may be transported to an MPL removal facility from a production facility where the catalytic reformer is in operation. Alternatively, a reactor component may have the MPL removed at a removal facility and subsequently transported to a final assembly location. In such embodiments, the removal of the MPL at some site distal to the production facility wherein the reactor is in operation may allow for less reactor downtime. Alternatively, a component of an existing reactor system may be disassembled, and the MPL removed or the component replaced with a component lacking an MPL.

The following enumerated embodiments are provided as non-limiting examples:

1. A method of removing a metal protective layer from a surface of a reactor component comprising treating the metal protective layer with one or more chemical removal agents to remove at least a portion of the metal protective layer from the reactor component.

2. The method of embodiment 1 further comprising a step of sequestering a movable metal compound, the one or more chemical removal agents, or the combination thereof resulting from treatment of the metal protective layer.
3. The method of embodiment 1 or 2 wherein the one or more chemical removal agents comprises halogen-containing compounds, sulfur-containing compounds, oxygen containing compounds, or combinations thereof.
4. The method of embodiment 1 or 2 wherein the one or more chemical removal agents comprises elemental halogens, acid halides, alkyl halides, aromatic halides, organic halides, inorganic halide salts, halocarbons, or combinations thereof.
5. The method of embodiment 1 or 2 wherein the one or more chemical removal agents comprises chlorine gas, hydrochloric acid, hydrofluoric acid, sulfonyl chloride, oxygen, sulfuric acid, or combinations thereof.
6. The method of embodiment 1, 2, 3, 4, or 5 wherein the one or more chemical removal agents is present in an amount of from about 0.1 ppm to about 50,000 ppm.
7. The method of embodiment 1, 2, 3, 4, 5, or 6 wherein said treating with the one or more chemical removal agents at a temperature of from about 200° F. to about 1600° F.
8. The method of embodiment 1, 2, 3, 4, 5, 6, or 7 further comprising treating the metal protective layer with a mechanical removal agent.
9. The method of embodiment 8 wherein the mechanical removal agent comprises abrasive blasting, hydroblasting, an abrasive material, or combinations thereof.
10. The method of embodiment 8 wherein the mechanical removal agent comprises an abrasive blast pig, a hydroblast pig, or combinations thereof.
11. The method of embodiment 8, 9, or 10 further comprising heating the reactor component to a temperature of from about 100° F. to about 2000° F. prior to treatment with the mechanical removal agent.
12. The method of embodiment 8, 9, 10, or 11 further comprising heating the reactor component to a temperature of from about 100° F. to about 2000° F. following treatment with the mechanical removal agent.
13. The method of embodiment 1, 2, 3, 4, 5, 6, 7, 8, 9, 10, 11, or 12 wherein the metal protective layer comprises stannides, antimonides, bismuthides, silicon, lead, mercury, arsenic, gallium, indium, tellurium, copper, selenium, thallium, chromium, brass, intermetallic alloys, or combinations thereof.
14. The method of embodiment 1, 2, 3, 4, 5, 6, 7, 8, 9, 10, 11, 12, or 13 further comprising a step of determining a thickness of the metal protective layer and the reactor component prior to said treating and determining the thickness of the reactor component following said treating.
15. The method of embodiment 1, 2, 3, 4, 5, 6, 7, 8, 9, 10, 11, 12, 13, or 14 further comprising a step of applying a second metal protective layer to the surface of the reactor component.
16. The method of embodiment 1, 2, 3, 4, 5, 6, 7, 8, 9, 10, 11, 12, 13, 14, or 15 further comprising a step of converting a hydrocarbon by contacting the hydrocarbon with a zeolitic catalyst, wherein the hydrocarbon or reaction products from the converting contact the reactor component having the metal protective layer prior to said treating.
17. The method of embodiment 1, 2, 3, 4, 5, 6, 7, 8, 9, 10, 11, 12, 13, 14, 15, or 16 further comprising a step of converting a hydrocarbon by contacting the hydrocarbon with a zeolitic catalyst or a bimetallic reforming catalyst, wherein the hydrocarbon or reaction products from the converting contact the reactor component after said treating.
18. A method of removing a metal protective layer from a surface of a reactor component comprising:
   (a) treating the metal protective layer to remove the metal protective layer from the reactor component;
   (b) determining a thickness of the reactor component following treatment.
19. The method of embodiment 18 further comprising a step of applying a second metal protective layer to the reactor component after step b).
20. The method of embodiment 18 or 19 further comprising a step of converting a hydrocarbon by contacting the hydrocarbon with a zeolitic catalyst or a bimetallic reforming catalyst, after said treating.

While preferred embodiments of this disclosure have been shown and described, modifications thereof may be made by one skilled in the art without departing from the spirit and teachings of this disclosure. The embodiments described herein are exemplary only, and are not intended to be limiting. Many variations and modifications of this disclosure disclosed herein are possible and are within the scope of this disclosure. Use of the term "optionally" with respect to any element of a claim is intended to mean that the subject element is required, or alternatively, is not required. Both alternatives are intended to be within the scope of the claim. Use of broader terms such as "comprises," "includes," "having," etc. should be understood to provide support for narrower terms such as "consisting of," "consisting essentially of," "comprised substantially of," etc. Unless specified to the contrary or apparent from the plain meaning of a phrase, the word "or" has the inclusive meaning. The adjectives "first," "second," and so forth are not to be construed as limiting the modified subjects to a particular order in time, space, or both, unless specified to the contrary or apparent from the plain meaning of a phrase.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the preferred embodiments of the present invention. The discussion of a reference herein is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A method of removing a first metal protective layer from a surface of a component of a catalytic reforming reactor comprising:

converting at least a portion of a hydrocarbon feed stream to provide aromatic hydrocarbons by contacting the hydrocarbon feed stream with a first reforming catalyst in the catalytic reforming reactor, wherein the hydrocarbon feed and the aromatic hydrocarbons contact the first metal protective layer;

removing the first reforming catalyst from the catalytic reforming reactor;

treating the first metal protective layer of the component of the catalytic reforming reactor with a mechanical removal agent to remove at least a portion of the first metal protective layer from the surface of the component of the catalytic reforming reactor;

heating the component of the catalytic reforming reactor to a temperature from about 120° F. to about 2,000° F. for from about 1 hour to about 500 hours following application of the mechanical removal agent;

after heating the component, treating the first metal protective layer with one or more chemical removal agents in an amount of from about 0.1 ppm to about 50,000 ppm to remove a remaining portion of the first metal protective layer from the reactor component at a temperature from about 200° F. to about 1,600° F. for from about 1 hour to about 500 hours; and loading the catalytic reforming reactor with a second reforming catalyst comprising a zeolitic reforming catalyst or a bimetallic reforming catalyst, wherein the first metal protective layer comprises stannides.

2. The method of claim 1 wherein the first. reforming catalyst is a zeolit.ie reforming catalyst selected from the group consisting of rhenium on an alumina support, iridium on an alumina support, platinum on a type X zeolite, platinum on a type Y zeolite, platinum on a cation exchanged type L zeolite, and a large-pore zeolite including an alkali or alkaline earth metal charged with one or more Group VIII metals.

3. The method of claim 1 wherein the second reforming catalyst is a bimetallic reforming catalyst comprising:

platinum, palladium, or rhodium;

at least one metal promoter, metallic activating element, or a combination thereof; and a halogen promoter.

4. The method of claim 1 wherein the second reforming catalyst is a sulfur-tolerant bimetallic reforming catalyst.

5. The method of claim 1 further comprising a step of sequestering a movable metal compound, the one or more chemical removal agents, or the combination thereof resulting from treating the metal protective layer.

6. The method of claim 1 wherein the. one or more chemical removal agents comprise halogen-containing compounds, sulfur-containing compounds, oxygen containing compounds, or combinations thereof.

7. The method of claim 1 wherein the one or more chemical removal agents comprise elemental halogens, acid halides, alkyl halides, aromatic halides, organic halides, inorganic halide salts, halocarbons, or combinations thereof.

8. The method of claim 1 wherein the one or more chemical removal agents comprise chlorine gas, hydrochloric acid, hydrofluoric acid, sulfonyl chloride, oxygen, sulfuric acid, or combinations thereof.

9. The method of claim 1 wherein the mechanical removal agent comprises abrasive blasting, hydroblasting, an abrasive material, or combinations thereof.

10. The method of claim I wherein the mechanical removal agent comprises an abrasive blast pig, a hydroblast pig, or combinations thereof.

11. The method of claim 1 further comprising heating the component of the catalytic reforming reactor to a temperature of from about 100° F. to about 2000° F. prior to applying the mechanical removal agent.

12. The method of claim 1 wherein the metal protective layer further comprises antimonides, bismuthides, silicon, lead, mercury, arsenic, gallium, indium, tellurium, copper, selenium, thallium, intermetallic alloys, or combinations thereof.

13. The method of claim 1 further comprising a step of determining a thickness of the metal protective layer and the reactor component prior to said treating and determining the thickness of the reactor component following said treating.

14. A method of removing a metal protective layer from a surface of a component of a catalytic reforming reactor consisting of treating the metal protective layer of the component of the catalytic reforming reactor by contacting the metal protective layer with a mechanical removal agent to remove the metal protective layer from the reactor component, wherein the metal protective layer comprises stannides; and heating the component of the catalytic reforming reactor to a temperature of from about 120° F. to about 2000° F. for from about 1 hour to about 500 hours following application of the mechanical removal agent.

15. The method of claim 14 wherein the mechanical removal agent comprises abrasive blasting, hydroblasting, an abrasive material, an abrasive blast pig, a hydroblast pig, or combinations thereof.

16. The method of claim 15 wherein the metal protective layer further comprises antimonides, bismuthides, silicon, lead, mercury, arsenic, gallium, indium, tellurium, copper, selenium, thallium, inter metallic alloys, or combinations thereof.

17. The method of claim 16 wherein the. component is a heat exchanger, a furnace interior wall, a furnace tube, a furnace liner, a reactor interior wall, a flow distributor, a riser, a scallop, or a. center pipe.

18. The method of claim 17 wherein the step of heating is performed to a temperature of from about 150° F. to about 2000° F.

* * * * *